US005087210A

United States Patent [19]

Myers et al.

[11] Patent Number: 5,087,210

[45] Date of Patent: Feb. 11, 1992

[54] WIRE-TO-WIRE ELECTRICAL CONNECTING MEANS

[75] Inventors: Ronald W. Myers, Landisburg; James Pritulsky, Hummelstown, both of Pa.

[73] Assignee: AMP Incorporated, Harrisburg, Pa.

[21] Appl. No.: 719,222

[22] Filed: Jun. 21, 1991

[51] Int. Cl.[5] ..... H01R 4/24

[52] U.S. Cl. ..... 439/425; 439/607; 439/676

[58] Field of Search ..... 439/389–425, 439/676, 607–610

[56] References Cited

U.S. PATENT DOCUMENTS

| | | | |
|---|---|---|---|
| 4,838,811 | 6/1989 | Nakmura et al. | 439/607 |
| 4,863,401 | 9/1989 | Talend | 439/610 |
| 4,981,447 | 1/1991 | Ichitsubo | 439/607 |
| 4,983,127 | 1/1991 | Kawai et al. | 439/607 A |

*Primary Examiner*—Joseph H. McGlynn
*Attorney, Agent, or Firm*—David L. Smith

[57] ABSTRACT

There is disclosed, a kit of parts for assembly to provide a wire-to-wire shielded electrical connector (2) comprising an insulating housing (4) having a forward portion (12) defining a socket (50) for receiving a shielded electrical plug (170), and a rear portion (10) defining a row of passageways (18) for receiving respective wires (W) of a shielded electrical cable (C). Electrical terminals (6) have insulation displacement portions (84) which, in the assembled connector (2), are received in first slots (16) in the rear housing portion (10), and retention portions (86) which are received in second slots (66) in the forward housing portion (12), with contact springs (90) projecting from the retention portions (86) into the socket (50) for engagement by contacts (174) of the plug (170). The insulation displacement portions (84) of the terminals (6) can be driven home into the first slots (16) to engage the metal cores of the wires (W) when the wires (W) are received in the passageways (18). The terminals comprise flexible joggles (88) in order to ensure that the retention portions (86) are not disturbed as the insulation displacement portions (84) are driven home into the first slots (16). The contact surfaces (108) of the contact springs (90) are rolled surfaces of the terminals (6).

20 Claims, 9 Drawing Sheets

FIG. 3
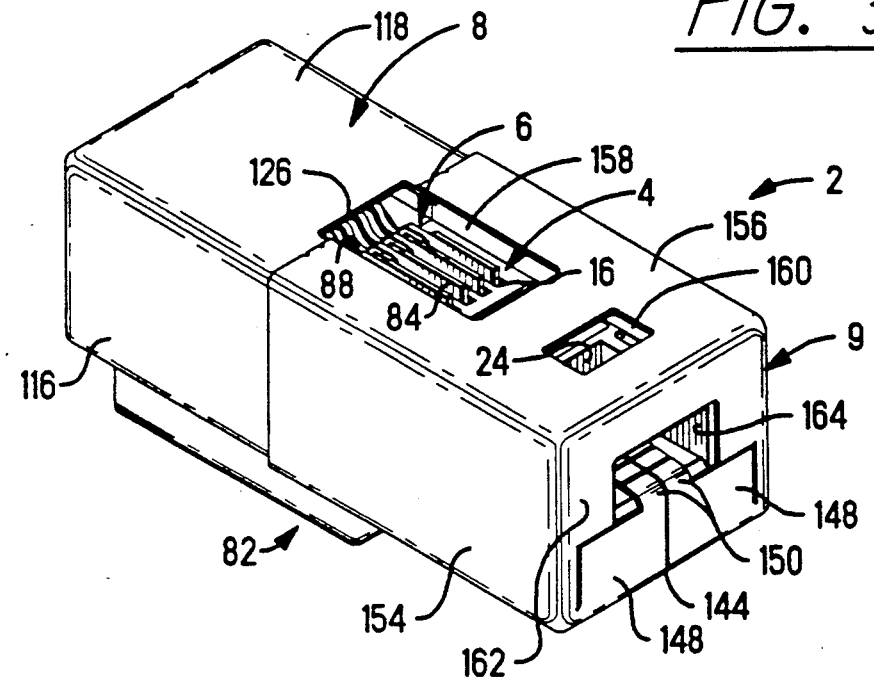
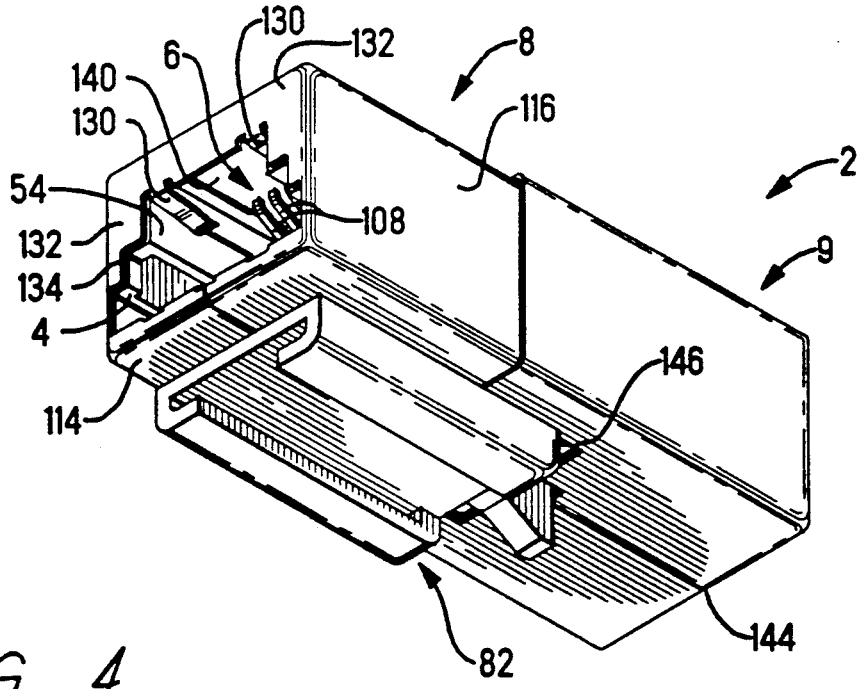
FIG. 4

WIRE-TO-WIRE ELECTRICAL CONNECTING MEANS

BACKGROUND OF THE INVENTION

This invention relates to a kit of parts for assembly to provide a wire-to-wire shielded electrical connector, to an electrical terminal therefor, to a housing therefor and to a wire-to-wire shielded electrical connector.

There are disclosed for example US-A-4,457,575, US-A-4,577,920, US-A-4,778,407 and US-A-4,952,170, electrical connectors of the kind known as shielded data link electrical connectors. Such connectors comprise shielded electrical plugs for connection to multi-conductor shielded electrical cables, and shielded electrical jacks for mating with the plugs and for mounting on a circuit board, thereby to provide wire-to-board connections. Such connectors are used, for example, in harnesses for connecting electronic devices, for example, disc players, automotive vehicles. The need, however, sometimes arises for such a harness to be disconnectably extended, that is to say for a further length of multi-conductor shielded cable to be disconnectably connected to a similar cable and the existing harness, to lengthen it. For this purpose, a suitable wire-to-wire shielded electrical connector is needed.

SUMMARY OF THE INVENTION

According to one aspect of the present invention, a kit of parts for assembly to provide a wire-to-wire shielded electrical connector, comprises an insulating housing having a forward portion defining a socket for receiving a shielded electrical plug and a rear portion defining a row of wire receiving passageways and having means for retaining wires therein. The forward portion of the housing has a first row of slots communicating with the interior of the socket, and the rear portion of the housing has a second row of slots, each axially aligned with, and communicating with, a respective slot of the first row of slots and with a respective one of the passageways. The kit of parts further includes a metal shield means, for example a two part shield, for receiving the insulating housing therein and having an aperture exposing the second row of slots. The kit of parts further includes a plurality of electrical terminals each comprising a wire connecting portion having insulation displacement means, for example prongs, and being dimensioned for insertion into a respective one of the slots of the second row, with the insulation displacement means projecting into the passageway with which said respective slot of the second row communicates. Each terminal also comprises a retention portion connected to the wire connecting portion and having retention means thereon. A contact spring projects from the retention portion. The retention portion is dimensioned for insertion into that slot of the first row which communicates with said respective slot of the second row, so as to be retained therein by the retention means, with the contact spring projecting into the interior of the socket.

When the terminals are in place in their respective slots, and wires of a shielded electrical cable have been inserted into the respective passageways of the rear portion of the housing, the wire connecting portions of the terminals can be driven down to home positions so that their insulation displacement means make electrical contact with the strands of the wires, which are typically insulated wires, and the shielded electrical plug can be inserted into the socket so that contacts of the plug make electrical contact with the contact springs therein.

The connector is preferably supplied to a customer with the wire connecting portions of the terminals releasably retained in the respective slots of the second row with the insulation displacement means of the wire connecting portions proximate to, but not projecting into, the respective passageways.

The retention means of the retention portions of the terminals serve to prevent the contact springs from being shifted relative to the housings when the wire connecting portions are driven down into their home positions, it being preferable, to this end, for the retention portion of each terminal to be connected to the wire connecting portion thereof by resiliently flexible means, for example a joggle of the terminal material. It is also preferable that the terminals should be so configured, so that the contact springs present rolled surfaces of the terminal material to the plug contacts.

Also preferably, the shield comprises spring beams for contacting shielding on the plug for shielding on the exterior of the multi-wire cable. According to other aspects thereof, the invention comprises an electrical terminal and an insulating housing for use in the kit of parts, and an electrical connector which has been assembled from the kit of parts for supply to a customer. All that the customer need do in or to lengthen an existing shielded electrical cable harness is to insert the wires of one suitably prepared end portion of a shielded electrical cable into respective wire receiving passageways of the housing, actuate the wire retaining means to secure the wires therein and drive the wire connecting portions of the terminals to their home positions, and then insert a plug of the existing harness into the socket of the wire-to-wire connector. The other end of said cable may be connected to a shielded electrical plug or to a wire-to-wire connector according to the invention.

Further objects and advantages of the present invention will appear from the following description relating to the accompanying drawings which are presented herein solely by way of example.

BRIEF DESCRIPTION OF THE DRAWING

FIG. 3 is an isometric view of the connector taken from above;

FIG. 4 is an isometric view of the connector taken from below;

DESCRIPTION OF THE PREFERRED EMBODIMENT

Figure 1:
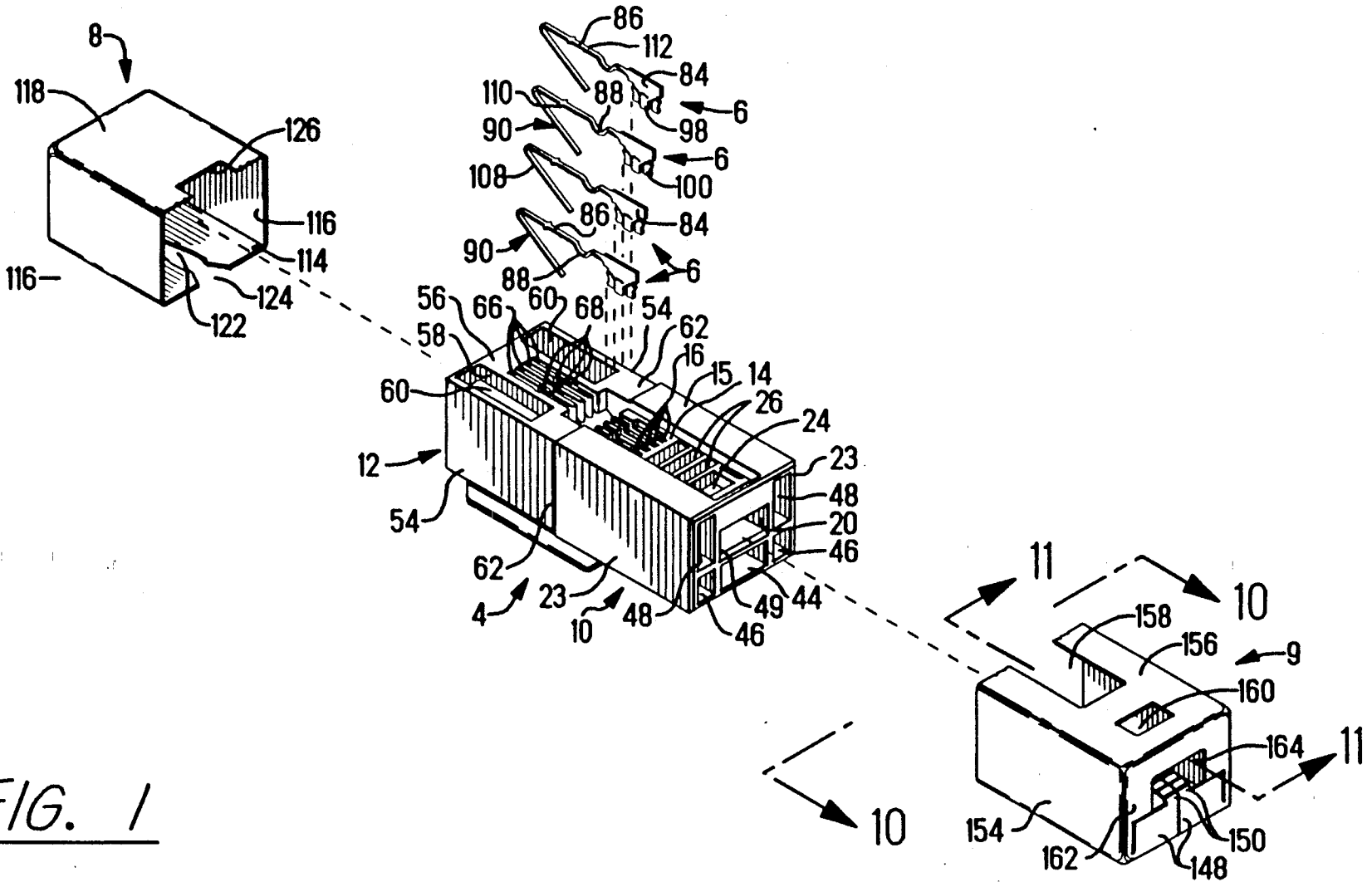
FIG. 1 is an exploded isometric view of a wire-to-wire shielded electrical plug receptacle connector according to an embodiment of the invention, the connector comprising an insulating housing, a set of electrical terminals and a two-part outer metal shield.

A wire-to-wire shielded data link electrical plug receptacle connector 2 comprises an insulating housing 4, a set of four electrical terminals 6 and a two-part outer metal shield having a forward part 8 and a rear part 9. The preferred embodiment will be described with reference to a connector having four terminals, but the invention is not limited thereto.

Figure 5:
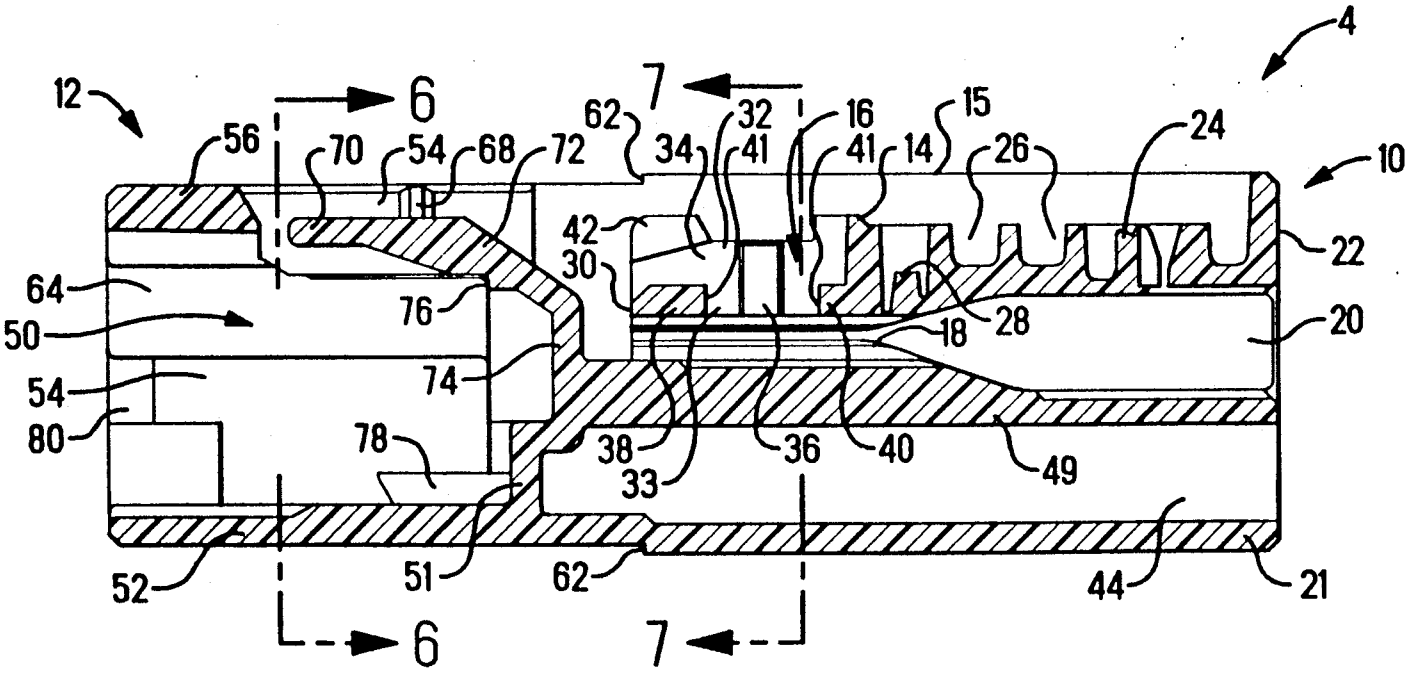
FIG. 5 is an enlarged longitudinal sectional view of the housing of the connector, a latching clip structure of the housing not being shown.
Figure 7:
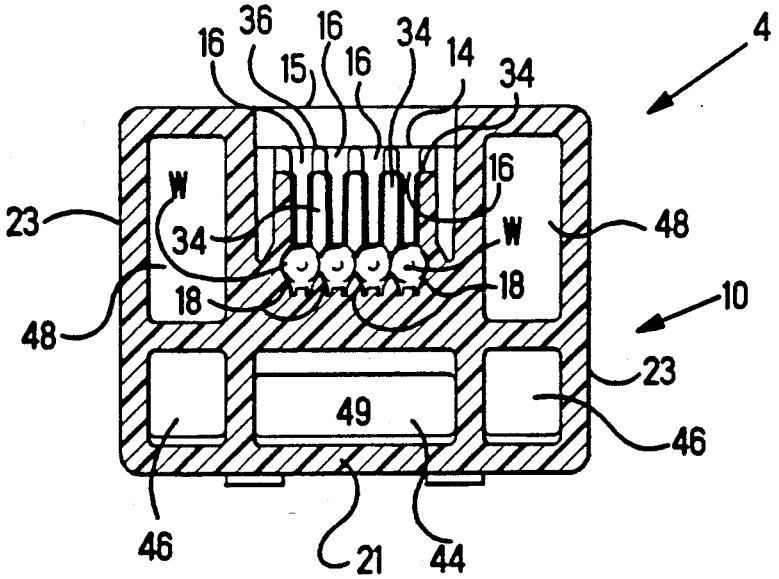
FIG. 7 is a view taken on the lines 7—7 of FIG. 5, showing wires in the housing in broken lines.
Figure 8:
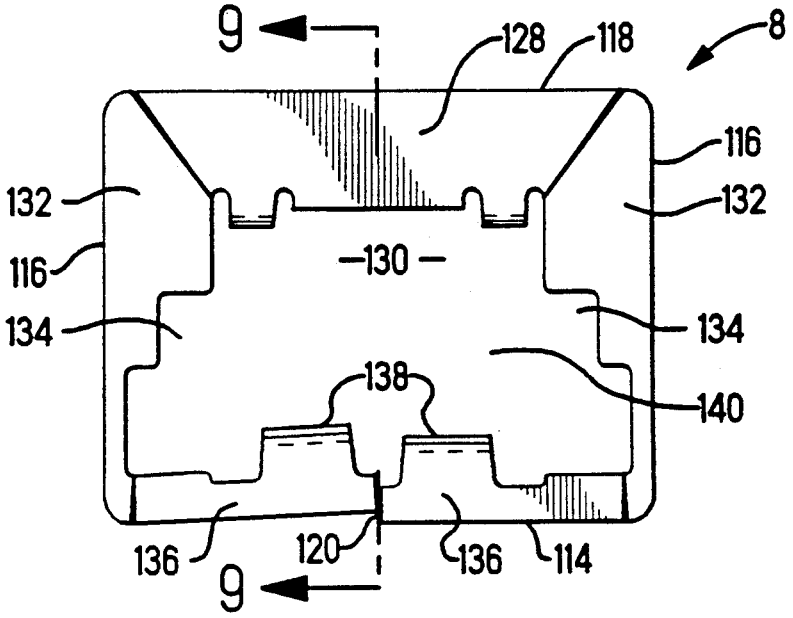
FIG. 8 is an enlarged front view of said forward part of the metal shield.
Figure 9:
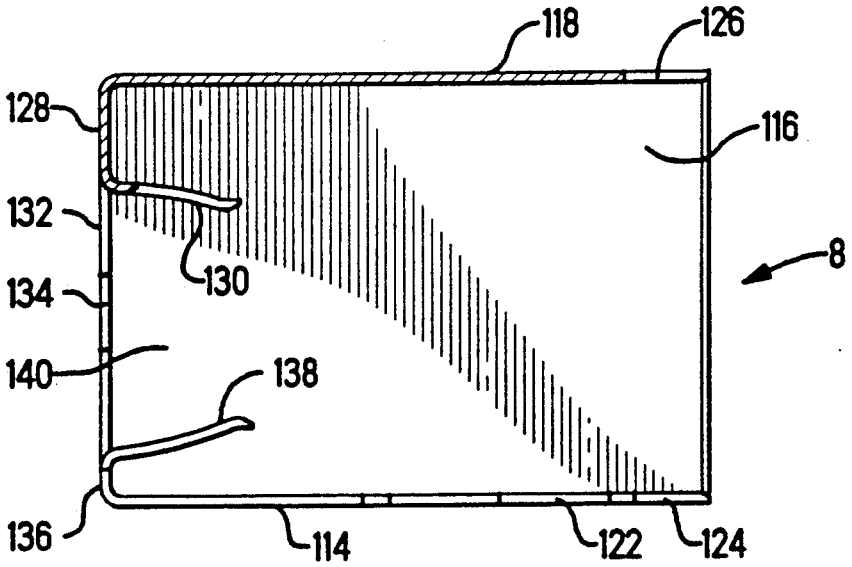
FIG. 9 is a view taken on the lines 9—9 of FIG. 8.
Figure 10:
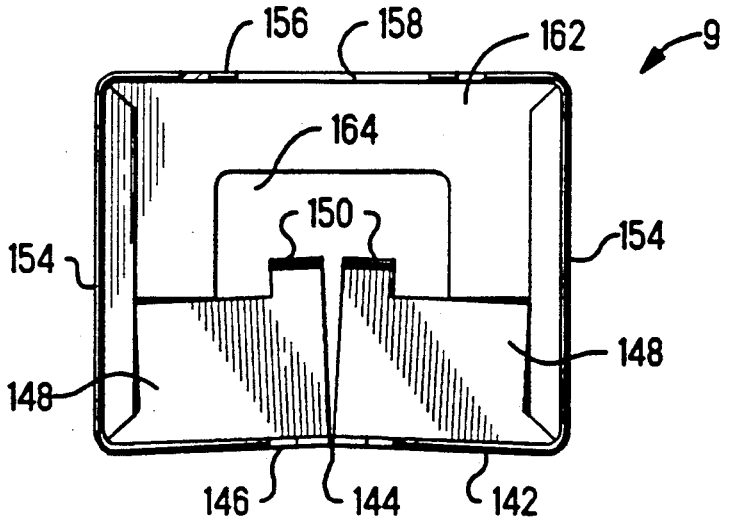
FIG. 10 is an enlarged view of the rear part of the shield taken on the lines 10—10 of FIG. 1.
Figure 11:
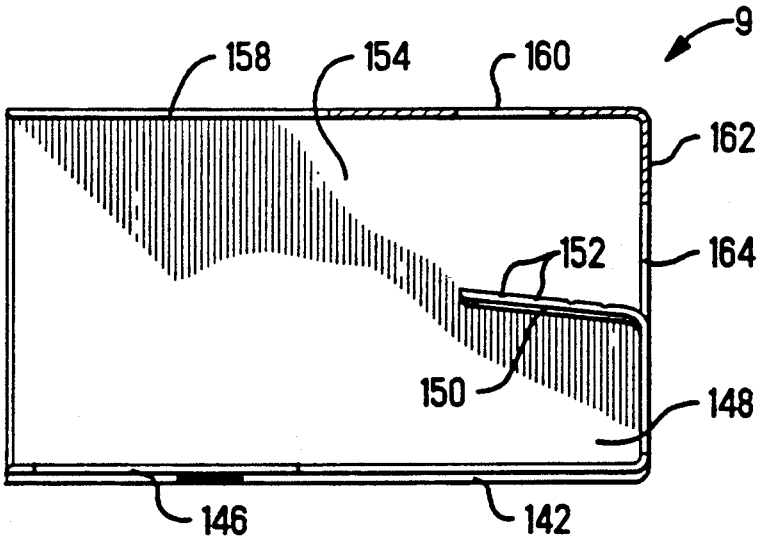
FIG. 11 is an enlarged view of the rear part of the shield taken on the lines 11—11 of FIG. 1.
Figure 12:
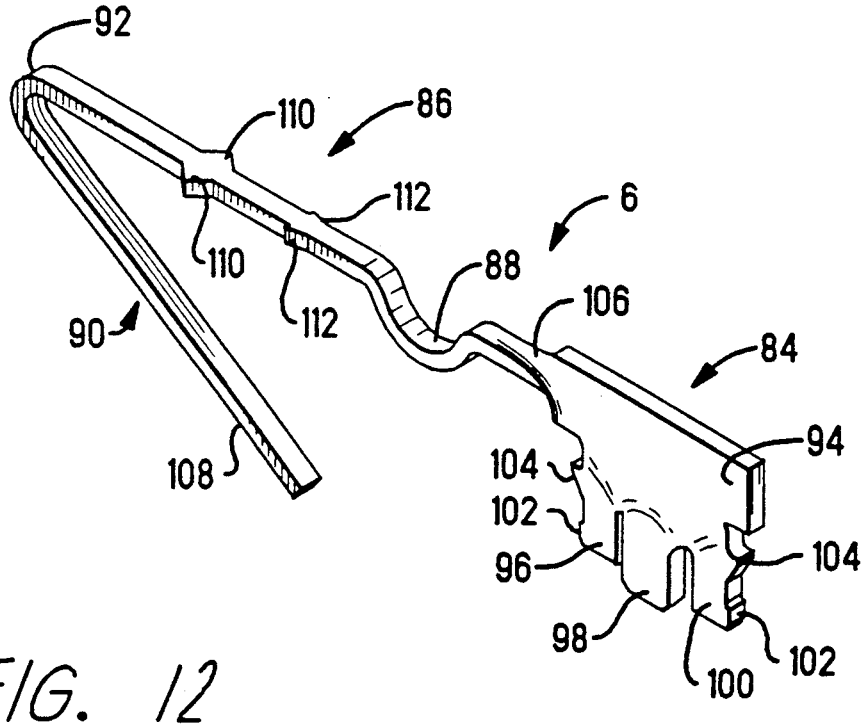
FIG. 12 is an enlarged isometric view of an electrical terminal of the connector.

The housing 4 which is of overall rectangular elongate shape and has been molded in one piece from a suitable synthetic resin, comprises a cable receiving rear portion 10 and a plug receiving forward portion in the form of a hood 12 projecting from the portion 10. There open into the face 14 of the housing portion 10, which is recessed below an upper wall 15 of the housing portion 10, four slots 16 arranged in parallel, spaced relationship transversely of the housing 4 and each of which communicates with a respective one of four cable wire receiving passages 18 in the housing portion 10. Each passageway 18 opens at its rear end into an enlarged cable jacket receiving mouth 20 which is common to the passageways 18 and which in turn opens in a rear, cable receiving face 22 of the housing portion 10. The housing portion 10 has a base wall 21 from opposite edges of which upstand side walls 23. The face 14 of the housing portion 10 is formed with a cable strain relief bar 24 extending across the mouth 20 and is also formed with tooling location keyways 26 disposed forwardly of the bar 24 and also extending across the mouth 21, between the keyways 26 and the slots 16. A cable wire strain relief bar 28 extends across the passageways 18 proximate to the mouth 20. Such keyways and strain relief bars are described in US-A-4,577,920, US-A-4,601,530 and US-A-4,952,170 which are hereby incorporated herein by reference. Each passageway 18 opens at its forward end into a shoulder 30 of the housing portion 10. Each slot 16 has a longitudinally enlarged upper part 32, opening into the shoulder 30 as its forward end and a longitudinally smaller part 33, as best seen in FIG. 5, opening into a respective passageway 18. The slots 16 are defined by spaced barriers 34 formed with retention recesses 36 opening into the slots 16, as best seen in FIGS. 5 and 7. Between the parts 32 and 33 thereof, each slot 16 has a pair of shoulders 38 and 40, respectively, which are aligned with each other longitudinally of the housing 4. The shoulders 38 and 40 have inner sides 41 defining said smaller part 33 of the slot 16. Each barrier 34 has an outwardly flared lead-in surface 42 above the shoulder 38 of the respective slot 16. The housing portion 10 has core pin formed, longitudinally extending openings 44, 46 and 48, as best seen in FIGS. 1 and 7 for economy of the material of the housing 4. The opening 44 lies beneath the passageways 18 and the mouth 20 and is terminated at its forward end by a wall 51 common to the housing portion 10 and the hood 12. The openings 46 are disposed on opposite sides of the opening 44 and the openings 48 are disposed on each side of the mouth 20. The housing portion 10 has, above the opening 44, a central wall 49 defining the bottoms of the passageways 18 and mouth 20.

Figure 6:
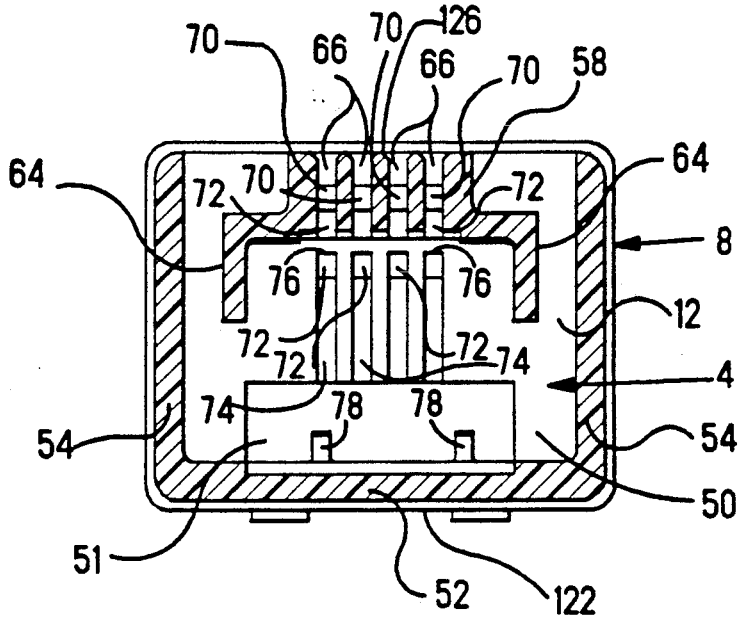
FIG. 6 is a view taken on the lines 6—6 of FIG. 5 and showing a forward part of said two-part shield.

The hood 12 has forwardly opening, plug receiving socket 50 having a base wall 52 from opposite longitudinal edges of which upstand side walls 54, the upper ends of which are spanned a top wall 56 having a central portion 58, which is best seen in FIG. 1, extending between openings 60 in the wall 56 which are provided for economy of the material of the housing 4. The rear end of the wall 56 adjoins the upper wall 15 of the housing portion 10. The rear end of each side wall 54 adjoins a respective side wall 23 of the housing portion 10 and the rear end of the base wall 52 adjoins the base wall 21 of the housing portion 10, in each case with the interposition of an abutment step 62 (FIGS. 1 and 5), for the shield part 8. There depends from either side of the wall portion 58, a plug guide flange 64, as best seen in FIG. 6. The wall portion 58 is formed with a row of parallel through slots 66, the row extending transversely of the housing 4 and the slots 66 extending longitudinally thereof as best seen in FIGS. 1 and 6. Each slot 66 has therein, disposed substantially longitudinally centrally thereof, a pair of opposed, frusto-triangular section, terminal retention grooves 68, the pairs of grooves 68 of the slots 66 being staggered slightly from slot to slot, longitudinally of the housing 4, as shown in FIG. 1. There projects into each slot 66, a terminal support nose 70 extending from a respective cantilever arm 72 projecting obliquely upwardly from a respective vertical flange 74 on the forward end of the central wall 49 of the housing portion 10. The underside of each arm 72, is formed with a plug stop shoulder 76. There project from the rear part of the base wall 52 of the hood 12 and from the forward side of the wall 51, a pair of spaced keys 78 for cooperation with plug keyways referred to below. Within the socket 50 are latch blocks 80 each projecting from a respective one of the side walls 54 of the hood 12. There depends from the base walls 21 and 52, a latching clip structure 82 for securing the housing to another structure (not shown). The structure 82, which is not shown in FIGS. 5 to 7, is in any event not to be regarded as an integer of the present invention.

Each terminal 6, which has been stamped and formed from a single piece of sheet metal stock comprises, as best seen in FIG. 6, a rearward wire connecting portion 84 joined to the rear end of the rectilinear and coplanar retention portion 86 by way of a joggle 88. A rectilinear and coplanar contact spring portion 90 connected to the forward end of the retention portion 86 by way of a bight 92, extends obliquely rearwardly of the terminal 6, away from and in alignment with the retention portion 86. The wire connecting portion 84, which is substantially uniplanar comprises a body in the form of a flat plate 94 from the bottom edge of which depends a row of three insulation displacement prongs 96, 98 and 100. The outer edge of the two outer prongs 96 and 100 is formed with a laterally projecting initial retention projection 102 of generally rectangular shape, and which is located proximate to the free end of the prong. The outer edge of each of the two outer prongs 96 and 100 is also formed with a final retention barb 104 between the projection 102 and the body 94. The center prong 98 is slightly laterally offset from the two outer prongs 98 and 100 which are coplanar. The body 94 is connected to the joggle 88 by means of a twisted transition portion 106, in such a way that the plane of the body 94 is angularly displaced from that of the transition portion 86 by 90°, whereby the contact spring portion 90 has a working contact surface 108 constituted by a rolled surface of the stock from which the terminal 6 was stamped out and not by a sheared edge of the stock. The retention portion 86 is formed, towards the bight 92, with a pair of aligned triangular shaped retention spurs 110 projecting laterally and in opposite directions from the sheared edges of the portion 86. The spurs 110 are dimensioned so as to be complementary with, and to be received in respective grooves 68 of the slots 66. Between the spurs 110 and the joggle 88, the retention portion 86 is formed with a pair of opposed retention barbs 112, projecting in opposite directions from the sheared edges of the portion 86. Although all of the terminals 6 are otherwise identical, the pairs of spurs 110 of the four terminals 6 are spaced at slightly different distances from the bights 92 to correspond to the staggered arrangement of the grooves 68.

The forward part 8 of the metal shield 8, 9 which part is of substantially rectangular shape, comprises as best seen in FIGS. 1, 4, 8 and 9, a base wall 114, from opposite edges of which upstand side walls 116, the upper ends of which are bridged by a top wall 118. The base wall 114 has a central longitudinal through slot 120, which as best seen in FIG. 1 increases in width rearwardly of the wall 114 to provide a widened portion 122, having a rearwardly opening flared mouth 124. The side walls 116 are continuous and are unapertured and the top wall 118 has a rearwardly opening central rectangular notch 126. The rear end of the shield part 8 is open. There depends inwardly from the forward end of the wall 118, at right angles thereto, a flange 128 from which extends rearwardly of the shield part 8, a first pair of spaced, plug shield contacting, cantilever spring beams 130. From the forward end of each side wall 116, there extends inwardly thereof and at right angles thereto, a bent-in flange 132, the flanges 132 defining opposed recesses 134. The base wall 114 has on either side of the slot 120, an upwardly bent flange 136 projecting at right angles to the wall 114 and being formed with a second pair of spaced, plug shield contacting, cantilever spring beams 138 extending rearwardly of the shield part 8. The flanges 128, 132 and 136 cooperate to define a plug receiving opening 140.

Figure 2:
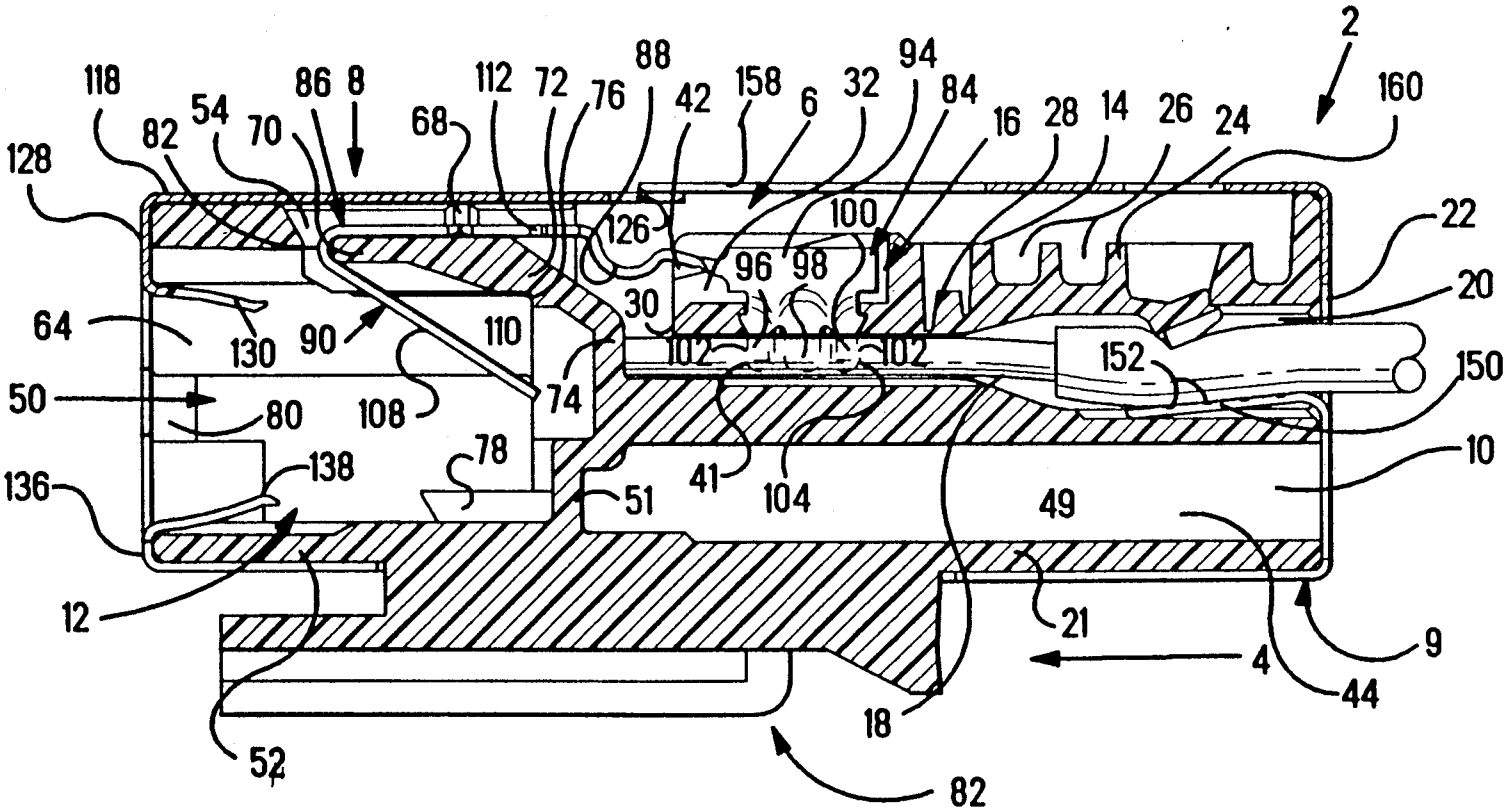
FIG. 2 is an enlarged longitudinal sectional view of the connector.

The part 9 of the metal shield 8, 9 which part is of substantially rectangular shape, comprises as best seen in FIGS. 1, 3, 10 and 11, a base wall 142 comprising two parts separated by a through longitudinal slot 114 having a forward widened portion 146. There upstands at right angles from the rear end of each part of the base wall 142, a bent-up flange 148 surmounted by a cable shield contacting cantilever spring beam 150 provided with cable shield gripping serrations 152 and projecting forwardly of the shield part 9. The beams 150 are provided on proximate margins of the flanges 148. Side walls 154 upstand from opposite edges of the base wall 142 and are bridged at their upper ends by a top wall 156 having a rectangular slot 158 opening into its forward end, and between the slot 158 and the rear end of the wall 156, a central rectangular opening 160. The shield part 9 has a rear wall 162 defining a cable receiving opening 164. The assembly of the terminals 6 and the shield parts 8 and 9 to the housing 4 will now be described. By means of suitable tooling (not shown) guided by the keyways 26, the terminals 6 are positioned so that each nose 70 of the hood 12 lies between the retention portion 86 and the contact spring portion 90 of a respective one of the terminals 6. Also by use of said tooling, the wire connecting portion 84 of each terminal 6 is inserted into a respective slot 16 of the rear portion 10 of the housing 4, guided by the respective lead-in surfaces 42, so that the central prong 98 of the terminal is received in the respective recess 36 and the projections 102 of the outer prongs 98 and 100 engage the inner sides 41 of the shoulders 38 and 40 defining the smaller part 33 of the slot 16, as shown in FIG. 2, whereby each connecting portion 84 is retained in its respective slot 16 in an initial position in which the prongs 96, 98 and 100 of the portion 84 do not protrude into the passageways 18, the barbs 104 of the prongs 96 and 100 being located in the larger part 32 of the slot 16 and consequently being out of engagement with any wall thereof. At the same time, the retention portion 86 of each terminal 6 is driven by the tooling, down into a respective one of the slots 66 of the hood 12, so that each spur 110 of the retention portion 86 is received in a respective groove 68 of the slot 66 and barbs 112 of the portion 86 is received in a respective groove 68 of the slot 66 and the barbs 112 of the portion 86 bite into the walls of the slot 66. As shown in FIG. 2, the retention portion 86 of the terminal 6 is now in a finally assembled position, in which the rounded free end of the respective nose 70 is received in the bight 98 of the terminal 6, the contact spring portion 90 of the terminal 6, projecting obliquely inwardly and rearwardly of the plug receiving socket 50 defined by the hood 12. In this position of each terminal 6, the upper edge of the body 94 of the portion 84 of the terminal is substantially level with the retention portion 86 of the terminal 6.

The housing 4 having been loaded with terminals 6 as described above, the shield parts 8 and 9 are now assembled to the housing 4. The shield part 8 is pushed over the hood 12, to an extent limited by the shield abutment step 62 and the engagement of the flanges 128 and 136 against the forward end of the hood 12. In this position of the shield part 8, the top wall 118 thereof covers the retention portions 86 of the terminals 6 and part of the clip structure 82 adjacent to the base wall 52 of the hood 12 is received in the widened portion 122 of the slot 120, having been guided thereinto by the mouth 124 of the slot 120. The spring beams 120 and 138 project into the plug receiving socket 50, the opening 140 being aligned with the socket 50. The slot 120 enables the shield part 8 resiliently to expand as it is mated with the hood 12, so that in its mated position, the shield part 8 resiliently grips the hood 12. The shield part 9 is pushed over the rear portion 10 of the housing 4 until the rear end of the portion 10 bottoms against the rear wall 162 of the shield part 9, whereby the spring beams 150 are received in the mouth 20 of the portion 10 and the part of the clip structure 2 adjacent to the base wall 21 is received in the widened portion 146 of the slot 144. The slot 158 in the wall 156 of the shield part 9 exposes the wire connecting portions 84 of the terminals 6 and the strain relief bar 28, and the opening 160 in the wall 156 exposes the strain relief bar 24; all as best seen in FIGS. 2 and 3, whereby access for tooling, to the portions 84 and the bars 24 and 28 is afforded. The cable receiving opening 164 is aligned with the mouth 20. As will be apparent from FIG. 2, the shield parts 8 and 9 overlap slightly at their adjacent margins and the slot 126 in the wall 118 of the shield part 8 constitutes a continuation of the slot 158 and is aligned with the joggle 88. By virtue of the slot 144, the shield part 9 is expanded resiliently as it is mated with the housing portion 10 and thus resiliently grips it in the mated position of the shield part 9.

The connector 2, assembled as described above, by its manufacturer, is now ready for shipment to an end user.

Figure 13:
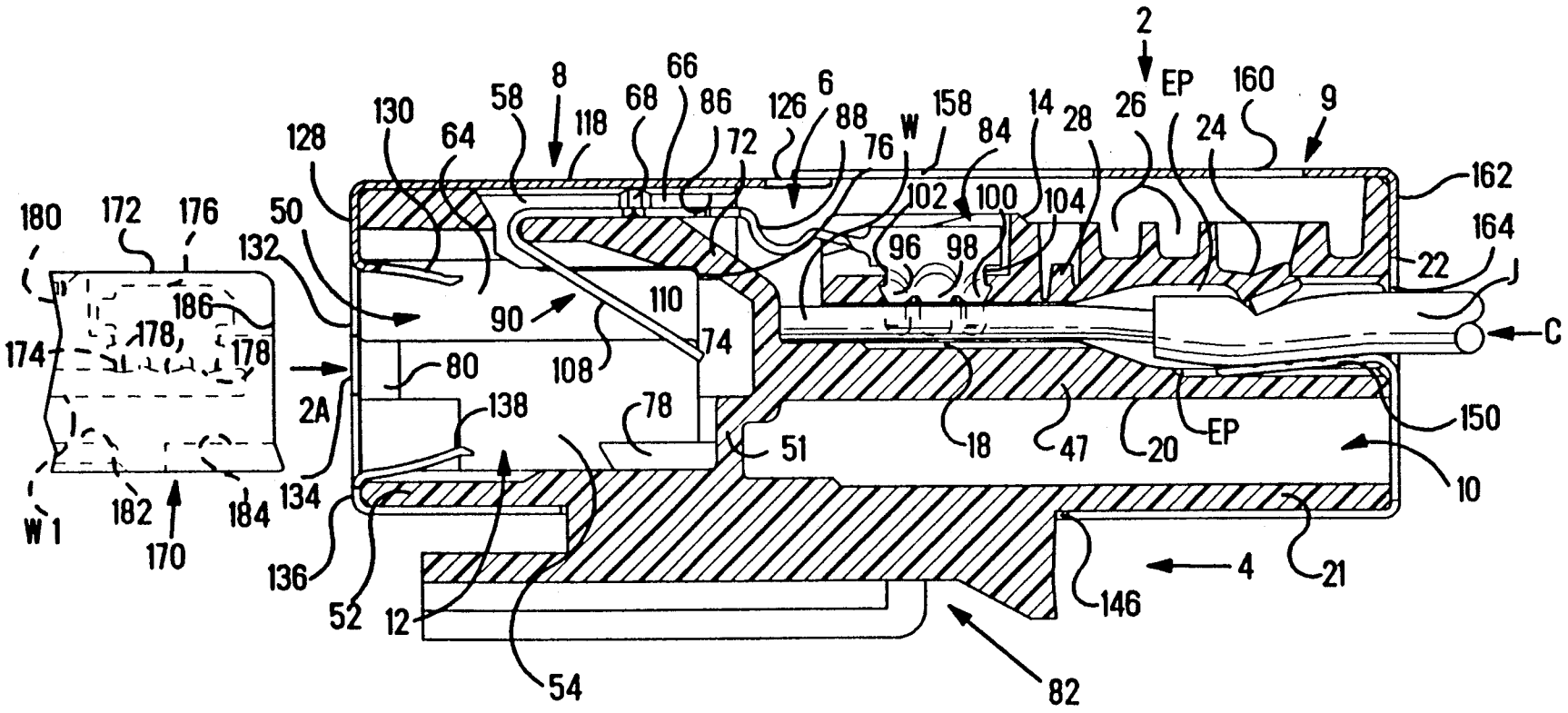
FIG. 13 is an enlarged longitudinal sectional view of the connector showing a shielded electrically cable terminated thereto and an electrical plug about to be mated with the connector.

In use of the connector 2, an end portion of a shielded, four wire cable C (FIG. 13) is prepared for termination by means of the connector 2 by stripping back the jacket J of the cable C, from the end portions of the four insulated wires W of the cable C and folding back end portions EP of the cable shield against the jacket J as shown in FIG. 13, in the manner described in US-A-4,577,920, referred to above. The end portion of the cable C, when so prepared, is inserted through the mouth 20 of the housing portion 10 by way of the opening 164 in the wall 162, so that each wire W is received in a respective passageway 18 (see FIG. 7), the end portion of the jacket J and the shield portions EP being received in the mouth 20. The insertion of the wires W is limited by the engagement of their ends, against the wall 74, as will be apparent from FIG. 13.

The end user then employs suitable tooling, to force in, by way of the slots 158 and 160 in the wall 156, the strain relief bars 28 and 24, respectively, to engage the wires W and the jacket J respectively, the lower (as seen in FIG. 13) shield portion EP being forced against the spring beams 150, securely to connect the cable shield electrically to the connector shield 8, 9. The end user also employs said tooling to force the wire connecting portion 84 of each terminal 6 down into a final position in which the barbs 104 of the portion 84 engage, and bite into, the sides 41, as shown in FIG. 13 and the springs 96, 98 and 100 of the portion 84 are forced through the insulation of the respective wire W to make firm electrical connection with the electrically core thereof. By virtue of the resilience conferred by the joggles 88 and the fact that the barbs 112 support the retention portions 86 in the slots 66, the retention portions 86 remain undisturbed in their fixed positions in the slots 66 despite the downward displacement of the wire connecting portions 84 of the terminals 6 to the extent that the upper edges of the plates 94 lie well below the retention portions 86.

The connector 2 is intended to mate with a shielded data link plug 170, a leading end portion of which is shown diagrammatically in FIG. 13. The plug 170 is of the kind described in US-A-4,577,920, US-A-4,601,530 and US-A-4,952,170; cited above. In the present example, the plug 170 comprises an insulating housing 172 receiving a four wire shielded cable having insulated wires W1 (only one of which is shown) which extend in a row through passageways in the housing 172. Contacts 174 (only one of which is shown) in the housing 172 have linear top contact surfaces 176 and prongs 178 engaging the electrically conductive cores of the wires W1, each contact 174 being thus connected to a respective one of the wires W1. A metal shield on the housing 172 has top and bottom external parts 180 and 182 and is connected to the cable shield. The forward end part of the housing 172 is formed with a pair of spaced keyways 184 (only one of which is shown) and which open into the leading end 186 of the plug 170.

In order to connect each wire W of the cable C to a corresponding wire W1 of the cable connected to the plug 170, the plug 170 is inserted into the socket 50 of the connector 2 in the direction of the arrow A in FIG. 13, with the end 186 of the plug 170 leading, until that end abuts the stop shoulders 76 and the wall 51, the keys 78 being then received in the respective keyways 184 of the plug 170 and the spring beams 130 and 138 engaging the shield parts 180 and 182, respectively, of the plug 170. Upon full insertion of the plug 170 into the socket 50, latch arms (not shown) of the plug 170 snap into engagement, after passing through the recesses 134 of the flanges 132, with respective ones of the latch blocks 80, so that the plug 170 is releasably retained in the socket 50 in mating relationship with the connection 2. As the plug 170 is being mated with the connector 2, the contact surface 176 of each contact 174 of the plug 170 engages against the contact surface 108 of the contact spring portion 90 of a respective one of the terminals 6, thereby resiliently moving it towards the retention portion 86 of the terminal 6. By virtue of the cooperation between the spurs 110 and the recesses 68 to retain the retention portions 86 firmly in position in the slots 66, the terminals cannot be displaced during the mating operation. Since the contact surfaces 176 of the contact 174 engage rolled surfaces 108 of the contact spring portions 90, excellent electrical contact is made between these contact surfaces.

What is claimed is:

1. A kit of parts for assembly to provide a wire-to-wire shielded electrical connector, the kits of parts comprising;

an insulating housing having a forward portion defining a socket for receiving a shielded electrical plug and a rear portion defining a row of wire receiving passageways and having means for retaining wires therein, the forward portion having a first row of slots communicating with the interior of the socket, and the rear portion having a second row of slots each axially aligned with, and communicating with, a respective slot of the first row of slots and with a respective one of said passageways;

metal shield means for receiving the insulating housing therein and being apertured to expose the second row of slots; and a plurality of electrical terminals each comprising a wire connecting portion having insulation displacement means and being dimensioned for insertion into a respective one of the slots of the second row with said insulation displacement means projecting into that one of the passageways with which said respective slot of the second row of slots communicates, a retention portion connected to the wire connecting portion, retention means on said retention portion and a contact spring projecting from said retention portion, the retention portion being dimensioned for insertion into that slot of the first row of slots which communicates with said respective slot of the second row of slots, so as to be retained in said slot of the first row by said retention means with said contact spring of the terminal projecting into the interior of said socket.

2. A kit of parts as recited in claim 1, wherein the wire connecting portion of each terminal is connected to the retention portion thereof by way of a resiliently flexible part of the terminal.

3. A kit of parts as recited in claim 2, wherein said resiliently flexible part is a joggle formed in said terminal.

4. A kit of parts as recited in claim 1, wherein the wire connecting portion of each terminal is substantially uniplanar, the contact spring of the terminal having a planar contact surface, the plane of which extends at right angles to that of the wire connecting portion.

5. A kit of parts as recited in claim 4, wherein the retention portion of the terminal is uniplanar, the plane of the retention portion extending at right angles to that of the wire connecting portion, a twisted section of the terminal connecting the retention portion thereof to the wire connecting portion thereof by way of a resiliently deflectable joggle.

6. A kit of parts as recited in claim 1, wherein said retention means of each terminal comprises a pair of opposed triangular shaped spurs projecting from the retention portion in opposite directions for reception in complementary shaped grooves in the housing, communicating with said respective slot of the second row of slots.

7. A kit of parts as recited in claim 6, wherein said retention means further comprise a pair of opposed retention barbs located between said spurs and the wire connecting portion of the terminal.

8. A kit of parts as recited in claim 1, wherein the metal shield comprises a first shield part for enclosing the forward portion of the insulating housing and a second shield part for enclosing the rear portion of the insulating housing in overlapping relationship with the first shield part.

9. A kit of parts as recited in claim 8, wherein each shield part is slotted for resilient engagement with its respective portion of the insulating housing.

10. A kit of parts as recited in claim 8, wherein the first shield part has at least one resilient cantilever beam projecting inwardly thereof, for engaging an external shield of said plug, when the first shield part has been assembled to the forward portion of the housing.

11. A kit of parts as recited in claim 8, wherein each wire receiving passageway of the rear portion of the housing communicates with a cable end portion receiving mouth opening into a rear end of the rear portion of the housing, the second shield part having at least one cantilever beam projecting inwardly thereof for engaging an external shield of a cable end portion inserted into said mouth, when the second shield part has been assembled to the rear portion of the housing.

12. An electrical terminal which has been stamped . and formed from a single piece of sheet metal, the terminal comprising:

a rearward wire connecting portion which is substantially coplanar and comprises a body in the form of a flat plate from a bottom edge of which depends a plurality of insulation displacement prongs;

an elongate planar retention portion having retention projections extending from opposite edges thereof, a first end of the retention portion being connected to said body by way of a twisted section of the terminal, whereby the plane of the retention portion extends transversely of the plane of said body; and a planar contact spring portion connected to a second end of said retention portion opposite to said first end thereof, by way of a bight of the terminal material, the contact spring portion extending rearwardly of the retention portion and towards the wire connecting portion, the contact spring portion lying opposite to the retention portion and the plane of the contact spring portion extending at right angles to the plane of said body.

13. A terminal as recited in claim 12, wherein said retention projections comprise triangular shaped spurs projecting in opposite directions from said opposite edges of the retention portion, and barbs projecting from said opposite edges between said spurs and said twisted section of the terminal.

14. A terminal as recited in claim 12, wherein said twisted section is connected to said retention portion by way of a resiliently flexible joggle, an upper edge of said body being substantially in alignment with said retention portion.

15. A terminal as recited in claim 12, wherein said prongs comprise two outer prongs which are coplanar with said body, and an inner prong disposed between said outer prongs, the inner prong being laterally offset from the outer prongs, an outer edge of each outer prong being formed with a substantially rectangular projection proximate to the free end of such outer prong and with a barb between said projection and said body.

16. An insulating housing for a wire-to-wire shielded electrical connector, the housing comprising a forward portion defining a socket for receiving a shielded electrical plug, and a rear portion defining a row of wire receiving passageways and having means for retaining wires therein, the forward portion having a first row of terminal receiving through slots formed in an upper wall of the forward portion, and beneath each slot a forwardly projecting, terminal supporting, cantilever nose connected to said rear portion of the housing and providing an upper wall of said socket, said rear portion of the housing having a second row of slots opening into an upper wall of said rear portion and each of these slots being axially aligned with, and communicating with, a respective slot of the first row of slots; each slot of said second row, having an upper part remote from said passageways and being elongate lengthways thereof, and a lower part which is shorter than said upper part lengthwise of said passageways and which opens into a respective one of said passageways.

17. A housing as recited in claim 16, wherein opposite sidewalls of each slot of the first row of slots are formed with frusto-triangular grooves opening into such slot in opposed relationship.

18. A wire-to-wire shielded electrical connector, comprising:

an insulating housing having a forward portion defining a socket for receiving a shielded electrical plug and a rear portion defining a row of wire receiving passageways and having means for retaining wires in the passageways, the forward portion having a first row of slots communicating with the interior of the socket and the rear portion having a second row of slots each axially aligned with and communicating with, a respective slot of the first row of slots and with a respective one of said passageways;

a metal shield having a first part receiving said forward portion of the housing and a second part receiving said rear portion thereof and having an opening exposing the second row of slots and an opening exposing said passageways to receive wires therein, the first part of the shield having an opening affording access to said socket for the insertion of said plug thereinto; and a plurality of electrical terminals each comprising a wire connecting portion having insulation displacement means and being lodged in a respective one of the slots of the second row, with said insulation displacement means proximate to the passageway with which said respective slot of the second row of slots communicates, a retention portion connected to said wire connecting portion, retention means on said retention portion and a contact spring projecting from said retention portion, the retention portion being retained by the retention means thereof in that slot of the first row of slots which communicates with said respective slot of the second row of slots with the contact spring of the terminal projecting into the interior of said socket for engagement by a contact of said shielded electrical plug when said plug has been inserted into the socket.

19. A connector as recited in claim 18, wherein said retention portion of each terminal is connected to the wire connecting portion thereof by means of a resiliently flexible joggle to allow said retention portion to be driven into a home position in which the insulation displacement means thereof are received in said respective passageway, without disturbing said retention portion of the terminal.

20. A connector as recited in claim 18, wherein the wire connecting portion of each terminal is substantially coplanar and is connected to the retention portion of the terminal by way of a twisted section thereof, whereby said contact spring presents a rolled surface for engagement by a respective contact of said shielded electrical plug.

* * * * *